United States Patent [19]

Vetter

[11] Patent Number: 4,617,758

[45] Date of Patent: Oct. 21, 1986

[54] SELF-LOCKING WINDOW OPERATOR

[75] Inventor: Gregory J. Vetter, Owatonna, Minn.

[73] Assignee: Truth Inc., Owatonna, Minn.

[21] Appl. No.: 572,827

[22] Filed: Jan. 23, 1984

[51] Int. Cl.[4] ..... E05F 11/00

[52] U.S. Cl. ..... 49/324; 49/342; 49/279

[58] Field of Search ..... 49/324, 248, 250, 251, 49/341, 342, 345, 346, 279, 281, 394; 74/425, 424.5, 424.6, 420.7, 89.14, 89.15

[56] References Cited

U.S. PATENT DOCUMENTS

| | | | |
|---|---|---|---|
| 1,297,479 | 3/1919 | Lane . | |
| 1,849,887 | 3/1932 | Siggins et al. . | |
| 1,905,921 | 4/1933 | Litchfield | 49/324 |
| 2,505,912 | 5/1950 | Reynaud | 49/324 |
| 2,709,582 | 5/1955 | Chapman | 268/23 |
| 2,824,735 | 2/1958 | Stavenau et al. | 49/324 |
| 3,044,131 | 7/1962 | Reynaud | 20/42 |
| 3,045,296 | 7/1962 | Silverman | 20/42 |
| 3,258,874 | 7/1966 | Martin | 49/252 |

FOREIGN PATENT DOCUMENTS 931713 7/1963 United Kingdom .

*Primary Examiner*—Kenneth Downey
*Attorney, Agent, or Firm*—Wood, Dalton, Phillips Mason, & Rowe

[57] ABSTRACT

A self-locking window operator having one or more arms transmitting a force from a drive mechanism to a window sash for positioning thereof and with the arms mounted and driven for rotational movement in positioning of the window sash and also mounted and driven for linear movement when the window sash is closed to achieve a locking action between the window sash and the window frame by engaging a locking mechanism which locks the window against high window-opening loads.

12 Claims, 6 Drawing Figures

SELF-LOCKING WINDOW OPERATOR

TECHNICAL FIELD

This invention pertains to a window operator for use with a pivotal window and, more particularly, an awning window. The window operator is self-locking to the window frame to avoid the exertion of high force levels against one or more arms of the operator when the window is closed, as can occur when there is an attempted forced entry or when negative air pressure conditions occur.

BACKGROUND ART

An awning window has a window frame with a window sash hinged at the top of the window frame. A window operator mounted at the bottom of the window frame has one or more arms operatively connected to the bottom of the window sash for moving the window sash in response to actuation of the window operator. An example of such a window operator is shown in the Stavenau U.S. Pat. No. Re. 26,508 wherein the operator arms of the window operator are relatively long and slender to permit flexing because of movement of the lower end of the window sash in an arc between open and closed positions. There is limited ability of such long and slender arms to withstand the force levels necessary to pass high load requirements as can occur upon attempted forced entry through the closed window or when there are negative air pressure conditions.

DISCLOSURE OF THE INVENTION

A primary feature of the invention is to provide a window operator which is self-locking and which locks the window sash to the window frame and avoids the application of high force levels to the window operator mechanism.

More particularly, it is a feature of the invention to provide a window operator for positioning of a pivotal window sash relative to a window frame which utilizes at least one arm extended between drive mechanism mounted on the window frame and the window sash and with the arm being mounted and driven for rotational movement to move the window sash and for linear movement when the window sash is closed to effect relative movement between locking means including a locking member on the arm and a keeper mountable on the window frame. The locking means positively locks the window sash to the window frame without high force levels applied to the window sash being withstood solely by the arm and drive mechanism of the window operator.

An object of the invention is to provide a self-locking window operator for an awning window having a housing mountable to the sill of a window frame, an arm mounted at one end within the housing and at its other end movably connected to the awning window, means in the housing mounting the arm for rotational movement to impart opening and closing movement to the window sash and also for linear movement when the window sash is closed to effect interengagement of locking means on the arm and the window frame, and means in the housing for causing both said rotational and linear movements.

Still another object of the invention is to provide a window operator comprising, a housing adapted for mounting on a window frame, a pair of worm gears mounted in said housing for rotation about axes extending lengthwise of said housing, a pair of arms connectable to a window sash and each having a sector gear in mesh with one of said worm gears, a pair of pivot pins fixed to said housing for mounting said arms, an elongate slot in each of said arms for receiving one of said pivot pins with said elongate slot extending generally parallel to the length of an arm, said arms having rotational movement with the pivot pins positioned at one end of the elongate slots and having linear movement by relative movement between the pivot pins and the elongate slots, a cam follower on each of said arms, a pair of cams on said housing for coacting with said cam followers and each having a curved section with a center of curvature coincident with a pivot pin to maintain said pivot pins positioned at one end of the elongate slots and a straight section extending parallel to the axis of rotation of the worm gears which permits linear movement of said arms in one direction and guides the arms for linear movement in an opposite direction, a pair of keepers mountable on the frame, and a lock member on each of said arms movable into and out of engagement with a keeper by linear movement of an arm in said one direction and said opposite direction, respectively.

BEST MODE FOR CARRYING OUT THE INVENTION

Figure 1:
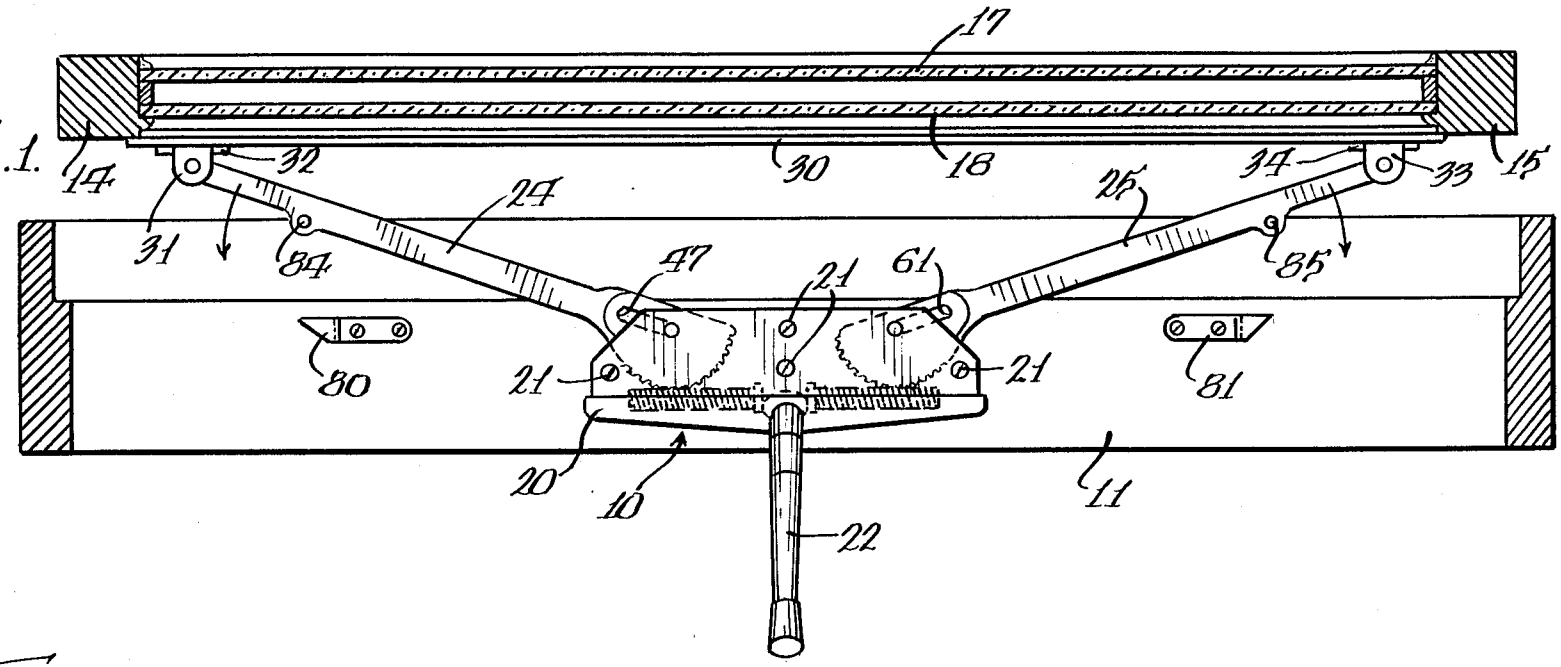
FIG. 1 is a plan view of the window operator shown in association with a window in plan section and with the window sash in partially-open position.
Figure 2:
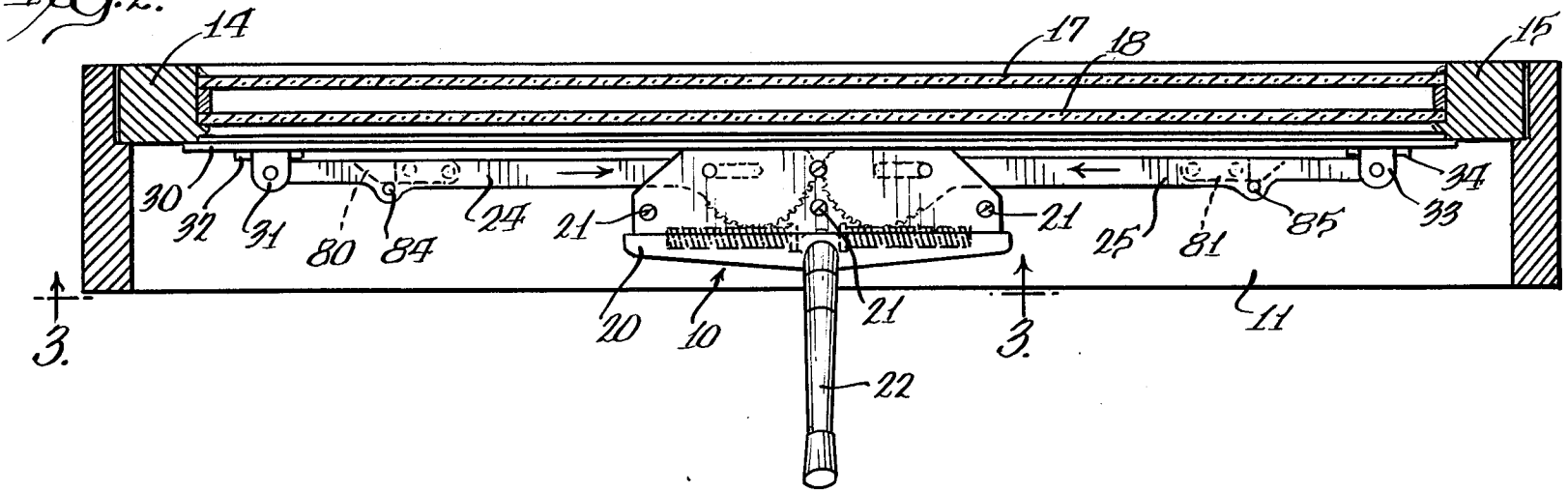
FIG. 2 is a view, similar to FIG. 1, showing the window in closed position.
Figure 3:
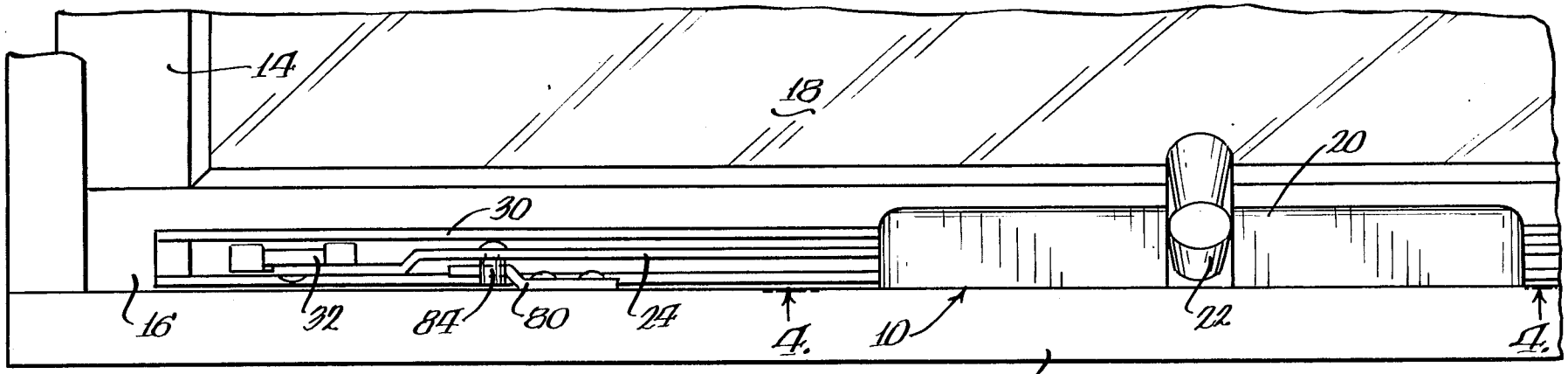
FIG. 3 is a vertical section on an enlarged scale taken generally along line 3—3 in FIG. 2.

The self-locking window operator, indicated generally at 10, is shown in association with a window in FIGS. 1-3. The window has a window frame and a window sash which are shown in plan section in FIGS. 1 and 2 and in fragmentary elevation in FIG. 3. The window has a window sill 11 and the window sash has side rails 14 and 15 which extend between top and bottom rails, with the bottom rail 16 being shown in FIG. 3. In the embodiment shown, the sash rails mount spaced-apart glass panes 17 and 18. The window is of the awning type wherein the window sash is hinged at or near the top and the window operator 10 connects to the bottom rail 16 of the window sash.

The window operator 10 has a housing 20 for mounting on the window sill 11 and which is shown attached thereto by fastening members 21. Drive means, described hereinafter, are mounted within the housing and are operable by rotation of a handle 22 extending upwardly from the housing.

The drive means are associated with a pair of arms 24 and 25 which each have an inner end 26 and 27, respectively, positioned within the housing 20. Each of the arms 24 and 25 has an opposite end movably associated with the window sash. More particularly, the bottom rail 16 of the window sash has a guide track 30 extending along the length thereof. The opposite ends of the arms 24 and 25 carry structure which can move along the guide track 30. The structure associated with said opposite ends of both arms is the same and with that shown in association with arm 24 being shown particularly in FIG. 3. The structure includes a carrier 31 pivoted to said opposite end of the arm 24 and which has a slider 32 which is confined within the guide track. The structure associated with the opposite end of the arm 25 includes the carrier 33 and a slider 34. The sliders 32 and 34 move from positions of maximum separation adjacent the sash side rails 14 and 15 to positions relatively close to each other when the window sash is fully open. The opening and closing movement of the window sash resulting from rotation of the handle 22 is achieved by rotative movement of the arms 24 and 25 through the action of the drive means within the housing 20.

Figure 4:
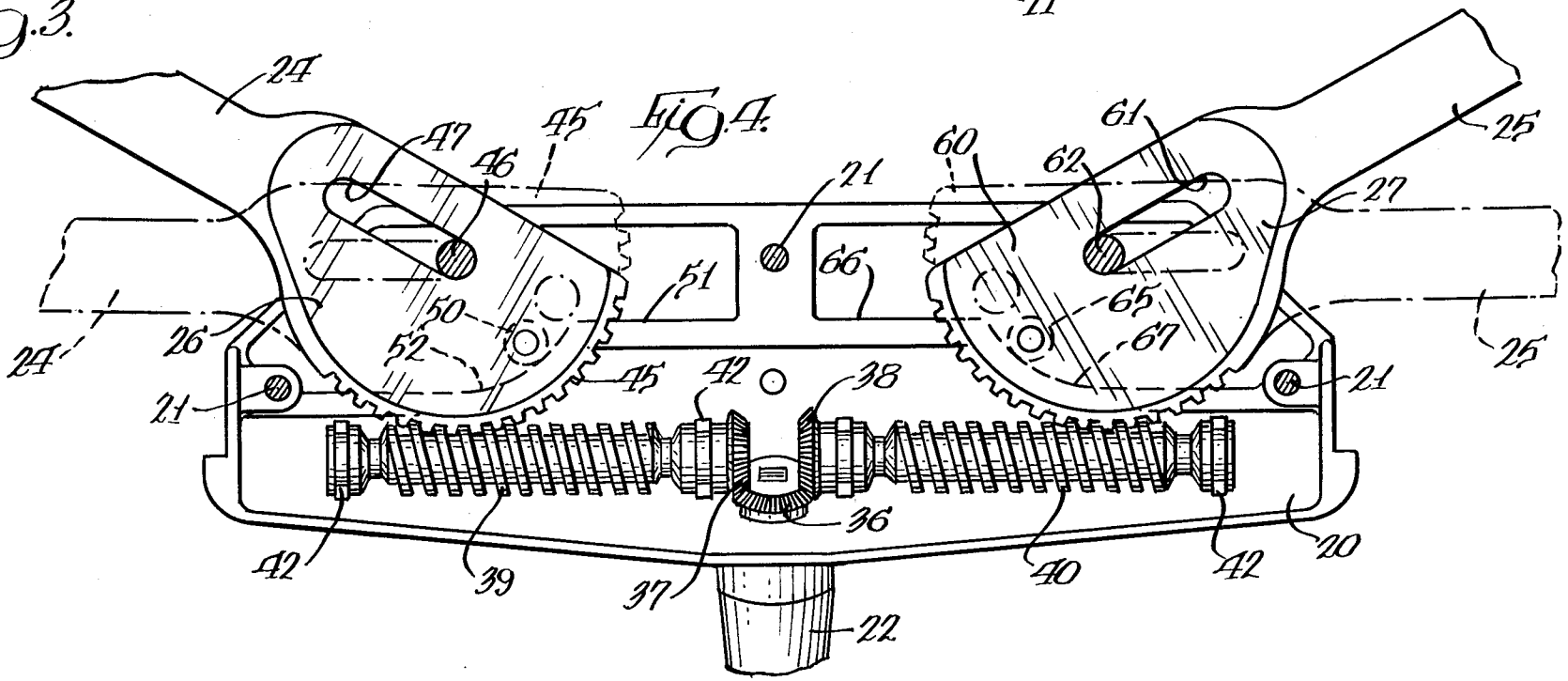
FIG. 4 is a fragmentary section taken generally along the line 4—4 in FIG. 3 and on a further enlarged scale and with the structure shown in full line generally in the position corresponding with the position of the window shown in FIG. 1.
Figure 5:
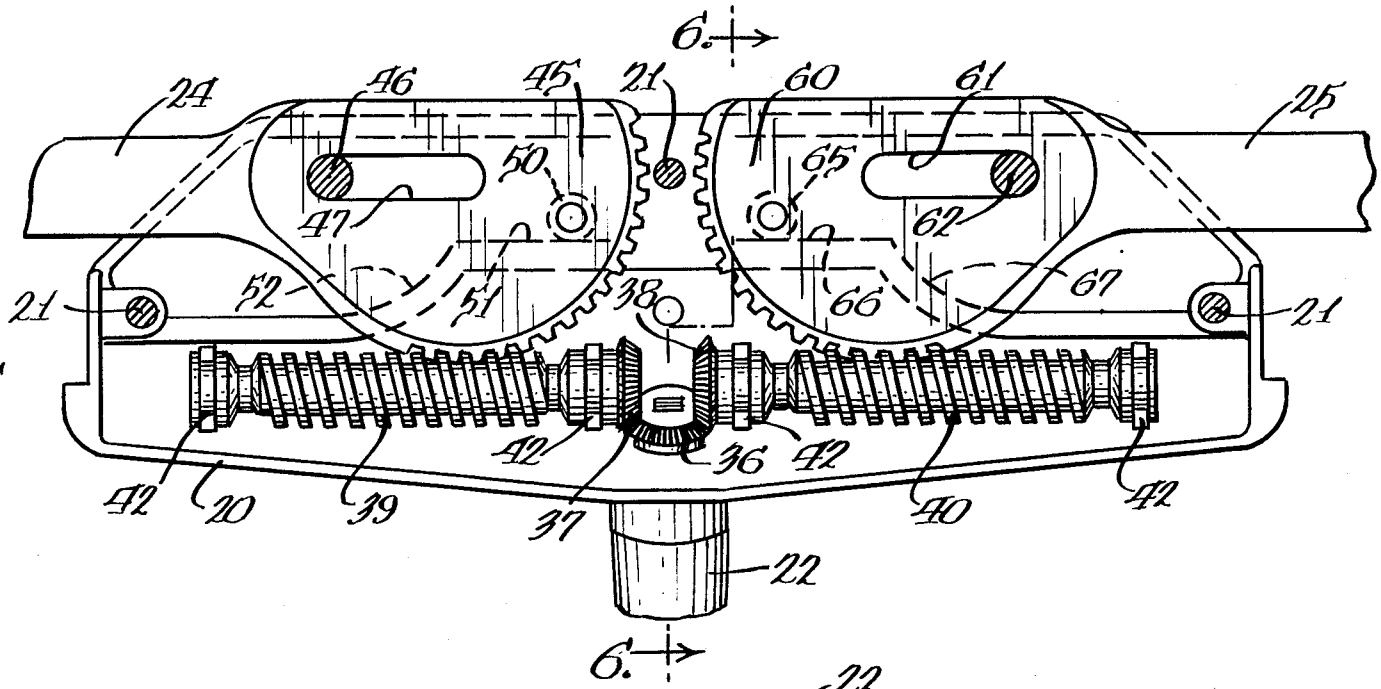
FIG. 5 is a view similar to FIG. 4 with the structure positioned corresponding to that shown with the window fully closed in FIG. 2.
Figure 6:
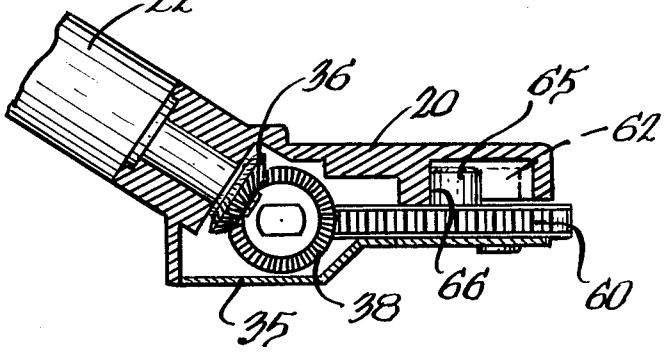
FIG. 6 is a fragmentary sectional view taken along the line 6—6 in FIG. 5.

The drive means is shown particularly in FIGS. 4–6, with the mechanism being viewed in FIGS. 4 and 5 from beneath the housing and with a housing base plate 35 removed. The handle 22 is splined to a bevel gear 36 which meshes with a pair of bevel gears 37 and 38 which are attached to a pair of worm gears 39 and 40, respectively. The worm gears 39 and 40 extend lengthwise of the housing and, therefore, lengthwise of the window sill 11 when the housing is attached thereto. The worm gears and associated bevel gears 37 and 38 are supported within the housing 20 by a series of worm-support members 42 extended between slots formed in the top wall of the housing and the housing base plate.

The worm gear 39 coacts with a sector gear 45 at the inner end of the arm 24 and which has a center coincident with the center of a pivot pin 46 fixed in the housing 20 when the arm 24 is positioned as shown in FIG. 4. The pivot pin 46 provides a mounting for the arm 24 for both rotational movement thereof in opening and closing of the window sash as well as for linear movement for a purpose to be described. The pivot pin 46 is positioned within an elongate slot 47 in the arm 24 and which extends generally lengthwise thereof. A cam and cam follower structure are associated with the arm 24 to coact with the pivot pin 46 and the forces exerted by the worm gear 39 to control the movement of the arm 24 where necessary. The cam and cam follower structure includes a cam follower 50 extending upwardly from the inner end of the arm 24 and a cam formed on the underside of the top wall of the housing 20 including a straight cam section 51 having a linear surface extending parallel to the axes of rotations of the worm gears 39 and 40 and a curved cam section 52 having a curved surface with a center which is coincident with the center of the pivot pin 46.

Assuming the window is in closed position and the window operator is positioned as shown in FIGS. 2 and 5, rotation of the worm gear 39 in a direction to cause opening of the window will urge the sector gear 45 to rotate in a clockwise direction about the pivot pin 46. However, the cam follower 50 is on the straight cam section 51 and, therefore, the sector gear is restrained against rotation and the force exerted by the worm gear causes linear movement of the arm 24 toward the left, as viewed in FIG. 5 until the cam follower 50 reaches the curved cam section 52. This movement is permitted by the elongate slot 47. The arm 24 is positioned as shown in broken line in FIG. 4 and the pivot pin is at the right-hand end of the elongate slot 47. Further rotation of the worm gear then causes rotation in a clockwise direction of the arm 24 to open the window. During this operation, the curved cam section 52 permits movement of the cam follower but is of no particular effect since the forces exerted by the worm gear are converted into rotary movement by the positioning of the pivot pin 46 in the right-hand end of the slot 47. When the window is in partially-open position, the arm 24 is shown as positioned in FIG. 1 and in full line in FIG. 4.

When the window is to be closed, the worm gear 39 is rotated in the opposite direction, with the force exerted on the sector gear urging the sector gear 45 in a counterclockwise direction. At this time, the arm 24 is restrained against linear movement by the cam follower 50 on the curved cam section 52 to maintain the pivot pin 46 in the right-hand end of the elongate slot 47. As the cam follower 50 moves on to the straight cam section 51, the arm 24 is no longer restrained against linear movement and further rotation of the worm gear 39 causes relative movement between the pivot pin 46 and the elongate slot 47 to position the pivot pin 46 in the left-hand end of the elongate slot. During this linear movement, the window is already closed so that the arm 24 is restrained against further counterclockwise rotation and the linear movement occurs.

The arm 25 is constructed similarly to the arm 24 and has a sector gear 60 which meshes with the worm gear 40 and an elongate slot 61 extending lengthwise of the arm which receives and is mounted upon a pivot pin 62 extended between the top wall of the housing 20 and the housing base plate 35. The inner end of the arm 25 carries a cam follower 65 which coacts with a straight cam section 66 and a curved cam section 67 corresponding to the cam sections 51 and 52 associated with the cam follower 50 of the arm 24. The operation of the arm 25 in both linear and rotational movements is the same as described for arm 24.

As mentioned previously, the rotational movement of the arms 24 and 25 provides for movement of the window sash between a closed position and various open positions, with the sliders 32 and 34 moving toward each other along the guide track 30 as the arms move more toward a parallel position in opening the window. In moving the window sash to a closed position, the arms 24 and 25 rotate to generally in-line positions shown in FIG. 2 wherein they extend generally parallel to the window sill 11 and, thereafter, the linear movement of the arms occurs to achieve a locking of the window sash to the window frame. This locking action is provided by a pair of keepers 80 and 81 mounted on the window sill which coact with locking members in the form of pins 84 and 85 extending downwardly from the arms 24 and 25, respectively, near their outer ends and which coact with the keepers 80 and 81, respectively. The path of rotation of the arms 24 and 25 moving to a closed position carries the locking members 84 and 85 in arcs beyond the ends of the keepers 80 and 81 and the subsequent linear movement of the arms 24 and 25 toward each other, as indicated by the arrows in FIG. 2, to the final position shown in FIG. 2 results in drawing the locking members behind the keepers as facilitated by the inclined ends of the keepers 80 and 81. When the window is to be opened, the handle 22 is rotated in the appropriate direction, first to obtain a separating linear movement of the arms 24 and 25 to move the locking members 84 and 85 beyond the ends of the keepers and, thereafter, the arms 24 and 25 are free to rotate, with the rotational movement as achieved by the drive mechanism referred to previously.

With the structure disclosed herein, the window sash is securely locked to the window frame by the coaction between the keepers on the window sill and the locking members on the arms near their outer ends, whereby substantial forces acting to open the window sash are resisted by mechanical connection between the window sash and window sill through a relatively short length of the operator arms rather than only through the relatively long slender operator arms.

I claim:

1. A window operator for positioning a window sash relative to a window frame comprising, gear drive mechanism mountable on said window frame, an arm connected between said gear drive mechanism and said window sash and having rotational movement for moving the window sash and linear movement when the window sash is closed, and coacting locking means including a member on said arm and a member mountable on said window frame which are moved into locking relation by said linear movement of said arm.

2. A window operator as defined in claim 1 wherein said arm has a floating connection to a fixed pivot pin whereby the arm can move linearly, and cam means for confining said arm against linear movement during the rotational movement thereof.

3. A window operator as defined in claim 1 wherein said gear drive mechanism includes a worm gear, a sector gear on said arm engaging said worm gear, and means mounting and guiding said arm whereby part of the motion imparted to the arm by the worm gear is said rotational movement and another part of the motion is said linear movement.

4. A self-locking window operator for a window having a window sash pivoted to a window frame comprising, an arm having an end movably connected to the window sash, a keeper on the window frame, a lock member on said arm, means for imparting linear movement to the arm when the window is closed to effect engagement and disengagement between said keeper and lock member, and gear means on the window frame for imparting rotational movement to said arm to cause opening and closing movement of said window sash.

5. A self-locking window operator for a window having a window sash pivoted to a window frame comprising, a housing, an arm having opposite ends with one end in said housing and the other end movably connected to the window sash, a keeper on the window frame at a distance from said housing, a lock member on said arm at a distance from said housing, means in the housing for imparting linear movement to the arm when the window is closed to effect engagement and disengagement between said keeper and lock member, and means in the housing for imparting rotational movement to said arm to cause opening and closing movement of said window sash.

6. A self-locking window operator as defined in claim 5 having a pair of said arms each having an end in said housing and said other end movably connected to said window sash at a distance from each other.

7. A window operator comprising, a housing adapted for mounting on a window frame, a first gear rotatably mounted in said housing, an arm connectable to a window sash and having a second gear in mesh with said first gear, a pivot pin fixed to said housing for mounting said arm, an elongate slot in said arm for receiving said pivot pin with said elongate slot extending generally parallel to the length of said arm, said arm having rotational movement with the pivot pin positioned at one end of the elongate slot and having linear movement by relative movement between the pivot pin and the elongate slot, a cam follower on said arm, a cam on said housing for coacting with said cam follower and having a pair of cam sections with one cam section maintaining said pivot pin positioned at one end of the elongate slot and the other cam section permitting linear movement of said arm along the pivot pin in one direction and guiding the arm for linear movement in an opposite direction, a keeper mountable on the frame, a lock member on said arm movable into and out of engagement with the keeper by linear movement of said arm in said one direction and said opposite direction, respectively, and said first gear operable at all time to exert a force on the second gear in a direction parallel to said other cam section.

8. A window operator comprising, a housing adapted for mounting on a window frame, a worm gear mounted in said housing for rotation about an axis extending lengthwise of said housing, an arm connectable to a window sash and having a sector gear in mesh with said worm gear, a pivot pin fixed to said housing for mounting said arm, an elongate slot in said arm for receiving said pivot pin with said elongate slot extending generally parallel to the length of said arm, said arm having rotational movement with the pivot pin positioned at one end of the elongate slot and having linear movement by relative movement between the pivot pin and the elongate slot, a cam follower on said arm, a cam on said housing for coacting with said cam follower and having a curved section with a center of curvature coincident with said pivot pin to maintain said pivot pin positioned at one end of the elongate slot and a straight section extending parallel to the axis of rotation of the worm gear which permits linear movement of said arm in one direction and guides the arm for linear movement in an opposite direction, a keeper mountable on the frame, and a lock member on said arm movable into and out of engagement with the keeper by linear movement of said arm in said one direction and said opposite direction, respectively.

9. A window operator comprising, a housing adapted for mounting on a window frame, a pair of worm gears mounted in said housing for rotation about axes extending lengthwise of said housing, a pair of arms connectable to a window sash and each having a sector gear in mesh with one of said worm gears, a pair of pivot pins fixed to said housing for mounting said arms, an elongate slot in each of said arms for receiving one of said pivot pins with said elongate slot extending generally parallel to the length of an arm, said arms having rotational movement with the pivot pins positioned at one end of the elongate slots and having linear movement by relative movement between the pivot pins and the elongate slots, a cam follower on each of said arms, a pair of cams on said housing for coacting with said cam followers and each having a curved section with a center of curvature coincident with a pivot pin to maintain said pivot pins positioned at one end of the elongate slots and a straight section extending parallel to the axis of rotation of the worm gears which permits linear movement of said arms in one direction and guides the arms for linear movement in an opposite direction, a pair of keepers mountable on the frame, and a lock member on each of said arms movable into and out of engagement with a keeper by linear movement of an arm in said one direction and said opposite direction, respectively.

10. A window operator comprising, a housing adapted for mounting on a window frame, a first gear rotatably mounted in said housing, an arm connectable to a window sash and having a second gear in mesh with said first gear, a pivot pin fixed to said housing for mounting said arm, an elongate slot in said arm for receiving said pivot pin with said elongate slot extending generally parallel to the length of said arm, said arm having rotational movement with the pivot pin positioned at one end of the elongate slot and having linear movement by relative movement between the pivot pin and the

11. A window operator for positioning a window sash relative to a window frame comprising, gear drive mechanism mountable on said window frame, an arm connected between said gear drive mechanism and said window sash and having rotational movement for moving the window sash and linear movement when the window sash is closed, said gear drive mechanism including a first gear, a second gear on said arm engaging said first gear, means mounting and guiding guding said arm whereby part of the motion imparted to the arm by the first gear is said rotational movement and another part of the motion is said linear movement and coacting locking means including a member on said arm and a member mountable on said window frame which are moved into locking relation by said linear movement of said arm.

12. A window operator as defined in claim 11 wherein said first gear is a worm gear and said second gear is a sector gear.

* * * * *

UNITED STATES PATENT AND TRADEMARK OFFICE

CERTIFICATE OF CORRECTION

PATENT NO. : 4,617,758

DATED : October 21, 1986

INVENTOR(S) : Gregory J. Vetter

It is certified that error appears in the above-identified patent and that said Letters Patent are hereby corrected as shown below:

Column 7, line 16, after "the" add:

--elongate slot, a cam follower on said arm, a cam on said housing for coacting with said cam follower and having a pair of cam sections with one cam section maintaining said pivot pin positioned at one end of the elongate slot and the other cam section permitting linear movement of said arm along the pivot pin in one direction and guiding the arm for linear movement in an opposite direction, lock means operable by said linear movement of the arm, and said first gear operable at all times to exert a force on the second gear in a direction parallel to said other cam section. --

Signed and Sealed this

Twenty-fourth Day of February, 1987

*Attest:*

DONALD J. QUIGG

*Attesting Officer* *Commissioner of Patents and Trademarks*